US005118031A

United States Patent [19]

Tighe

[11] Patent Number: 5,118,031

[45] Date of Patent: Jun. 2, 1992

[54] REMAILABLE POSTCARD CARD

[76] Inventor: John F. Tighe, Rabbit Hill, Drawer 1086, Truro, Mass. 02666

[21] Appl. No.: 701,797

[22] Filed: May 17, 1991

[51] Int. Cl.[5] ..... B42D 15/02

[52] U.S. Cl. ..... 229/92.8; 229/301

[58] Field of Search ..... 229/92.8, 73, 300, 301; 283/101

[56] References Cited

U.S. PATENT DOCUMENTS

| | | | |
|---|---|---|---|
| 263,347 | 8/1882 | Mead | 229/92.8 |
| 1,311,397 | 7/1919 | Herter | 229/92.8 |
| 4,278,199 | 7/1981 | Tanaka | 283/101 |
| 4,872,705 | 10/1989 | Hartfeil | 229/92.8 |

FOREIGN PATENT DOCUMENTS

| | | | |
|---|---|---|---|
| 835198 | 12/1938 | France | 229/92.8 |
| 260134 | 10/1926 | United Kingdom | 229/73 |

*Primary Examiner*—Stephen P. Garbe
*Attorney, Agent, or Firm*—Connolly & Hutz

[57] ABSTRACT

A remailable postcard includes a front side and a back side. The front side would be used in the initial mailing to indicate the original addressee and contain the necessary postage. The back side would have the portion indicating the address of the return addressee. In addition, return postage would be provided on the back side. The return addressee portion would be at least partially covered by a removable label. The card might also contain a tear off strip along the edge having the original postage. When the original addressee wishes to return the card the label would be removed to expose the return addressee information and the tear off strip would be detached to remove the original postage. The back side of the card would then contain the necessary postal information to permit the card to be remailed.

9 Claims, 2 Drawing Sheets

REMAILABLE POSTCARD CARD

BACKGROUND OF THE INVENTION

The present invention relates to remailable postcards, particularly those used in direct mail advertising and sales. Generally, such direct mail is used to contact prospective purchasers in an attempt to solicit information or sales in connection with the products, services or other activities of the direct mailer. It is particularly desirable if the remailability of such postcards could be made as convenient as possible so that there will be little difficulty in the prospective customer returning the postcard. There presently exists a wide variety of types of remailable postcards. These types include, for example, multi-layered cards wherein one or more layers must be detached before the returnable portion of the card can be sent back to the original mailer. Such cards, by their nature, are not particularly convenient to use.

It would be desirable if a remailable postcard could be provided which is simple in form and requires only minor manipulations by the original recipient to have the card returned.

SUMMARY OF INVENTION

An object of this invention is to provide a remailable postcard which meets the above needs.

A further object of this invention is to provide such a remailable postcard which can be conveniently returned to the sender by the original recipient simply being required to make minor physical alterations to the card. A further object to this invention is to provide such a remailable postcard which would qualify for major rate discounts in its postage.

In accordance with this invention the remailable postcard includes a front side which would contain the address of the original recipient as well as the necessary postage. In addition, the front side and/or back side could contain the information intended to be communicated to the recipient. In accordance with this invention, the back side of the postcard includes additional postage and has a portion of the back side with the address of the sender. That portion, however, is initially covered by a detachable label so that during the original mailing only the original recipient's address will prominently appear on the front side of the card. The card would also include a detachable stub or strip along the edge having the outbound posted indicia. When the original recipient desires to return the card to the sender, all that is necessary is to remove the label to expose the original sender's address and to detach the edge strip to remove the outbound postal indicia. The result is that the back side of the card then includes the necessary postage and the address of the sender.

If desired, the removable label could also, at least partially, conceal the return postage indicia. In a preferred practice of the invention, bar codes could be provided on both sides of the card to qualify for major rate discounts in both directions.

THE DRAWINGS

DETAILED DESCRIPTION

Figure 1:
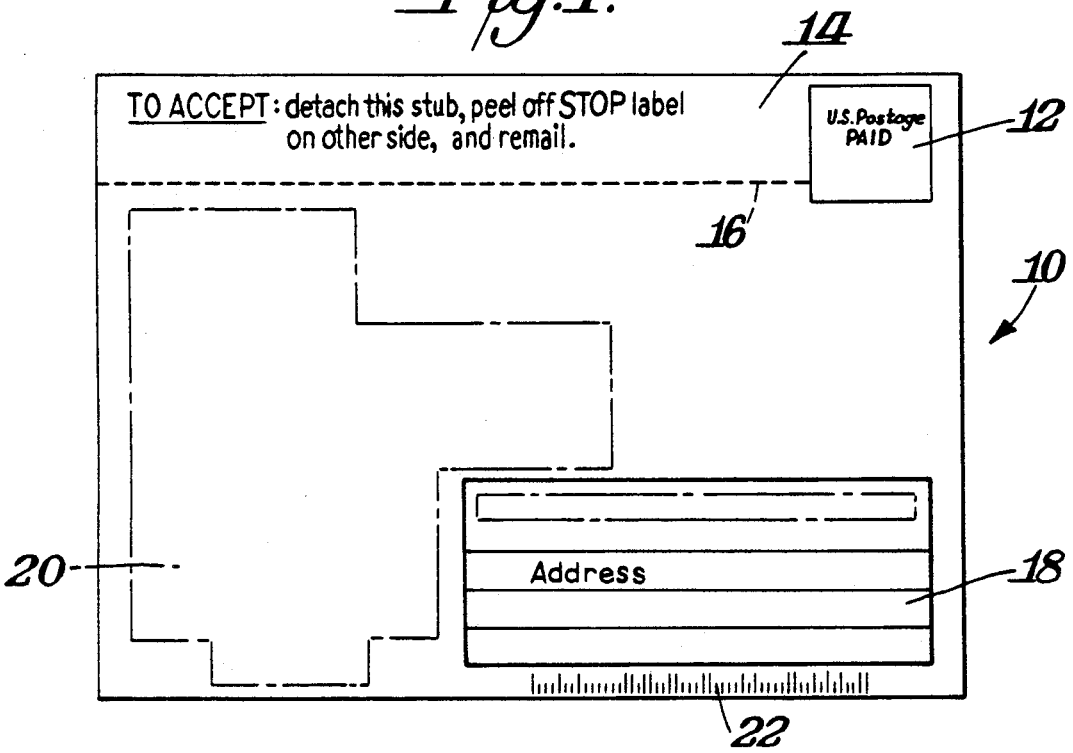
FIG. 1 is a front plan view of the front side of a remailable postcard in accordance with this invention.

The drawings illustrate a remailable card 10 in accordance with this invention. FIG. 1 illustrates the front side of the card in its condition when being sent to the original addressee. As shown therein, the outbound postal indicia 12 is provided along the upper edge of the card on part of a detachable edge strip 14 having, if desired, a perforation line 16 to facilitate detachment of edge strip 14 as later described. In addition, the front side includes a portion 18 which contains the address information of the original recipient. The front side may also include a portion 20 containing the information which is intended to be communicated to the recipient. As also shown in FIG. 1, a bar code 22 is provided to qualify for major rate discounts.

Figure 2:
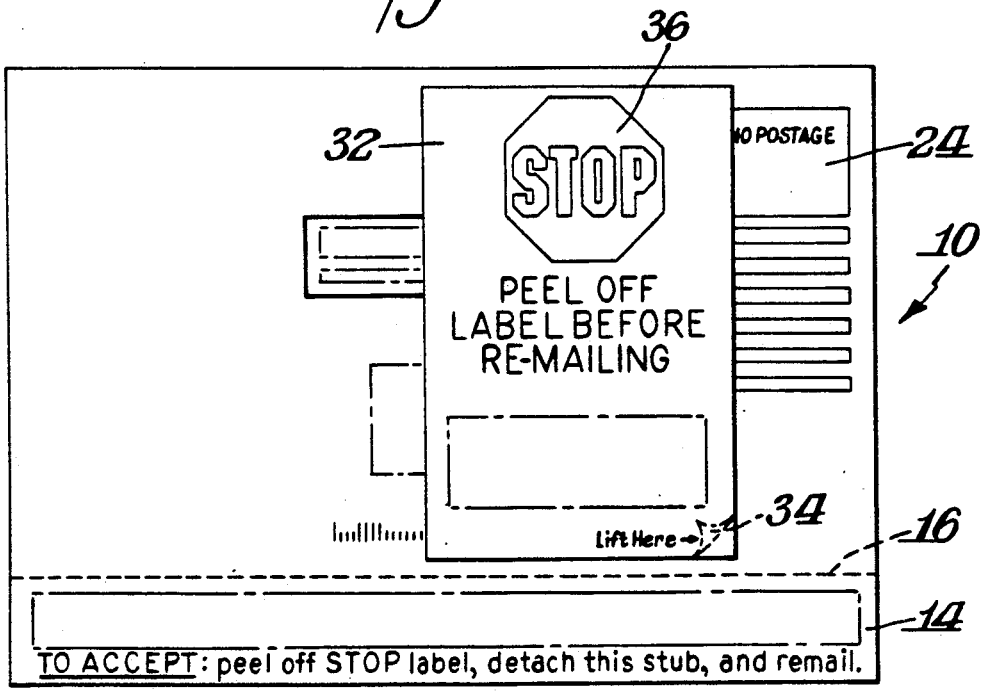
FIG. 2 is a plan view of the back side of the card shown in FIG. 1.
Figure 3:
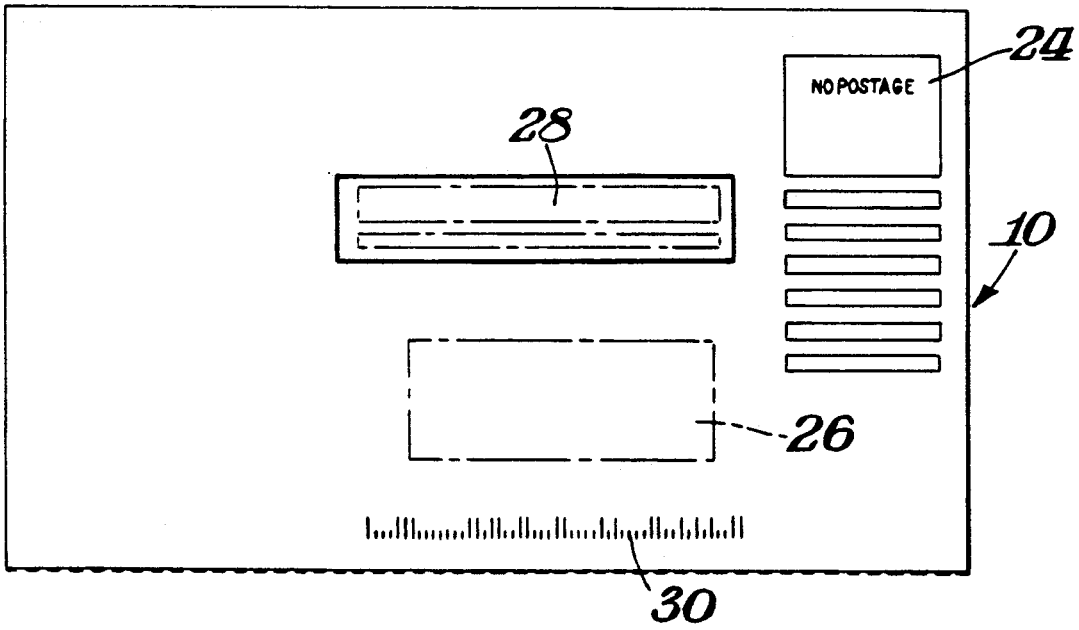
FIG. 3 is a plan view of the back side of the card shown in FIGS. 1-2 in a condition for remailing.

FIGS. 2-3 illustrate the back side of the card 10. As shown therein, the back side also includes postage indicia 24 on the corner diagonally opposite indicia 12. Thus, detachable stub 14 is located on the bottom of the back side when viewed in the proper position for reading by the recipient. As best shown in FIG. 3 the back side further contains the sender's address information in portion 26 of the card. A further portion 28 may contain other information such as an indication that this is a business reply mail with the indication of the permit number and any other necessary information. If desired, the back side might also contain information intended to be communicated to the original recipient. A bar code 30 is also provided on the back side to qualify the postcard for major rate discounts in the return mailing direction.

An important feature of this invention is illustrated in FIG. 2. This feature includes the provision of a peel off label 32 which would cover the business reply side of the postcard containing, for example, the information in areas 26 and 28. If desired, peel off label 22 may also cover at least part of the return postage indicia 24. Peel off label 32 could be applied in any conventional manner such as by means of an easily removable adhesive. In the preferred practice of the invention a corner 34 of peel off label 32 would be made more readily detachable than the remainder of the label to provide a means of grasping the label to facilitate its removal. As illustrated, peel off label 32 would contain directions to the original addressee so that the original addressee would readily known how to use card 10. For example, peel off label 32 might include a prominent stop sign 36 made in the familiar red octagonal shape with the word stop. Additional instructions such as indicated would also be provided so that the recipient would know that label 32 must be removed before remailing. FIG. 2 further illustrates the indication "lift here" at the corner 34. Similarly, instructions would be provided on strip off stub 14. FIG. 1 illustrates such instructions to include advising the original recipient that if the offer made on card 10 is to be accepted stub 14 should be removed as well as peel off label 32. The same type of instructions are preferably provided on the back side of stub 14.

Card 10 may be made of any suitable dimensions, such as 3 inches by 5 inches or 6 inches by 9 inches or 9 inches by 12 inches. An additional feature of the invention is that peel off stub or strip 14 might also function as a coupon which could be used by the original recipient for claiming some prize or obtaining samples, etc. from the sender. Thus, detachable strip 14 has the multiple functions of removing the outbound postage indicia and also being usable as a coupon.

In use if the recipient intends to return card 10 to the sender, label 32 would be removed by grasping corner 34 and simply peeling off label 32. Stub 14 would be removed by tearing at the perforated line 16. As is apparent from FIG. 1 the result of removing stub 14 would be to also remove the outbound postage indicia 12. The result of the removable of stub 14 and label 32 is clearly shown in FIG. 3 wherein the back side of card 10 is of standard postcard format which would include the necessary postal indicia 32 and the sender's address 26 displayed as the intended address.

As is apparent card 10 thus provides a particularly convenient structure and format which requires very little effort by the original recipient to remail the card.

What is claimed is:

1. A remailable postcard having a front side and a back side, said front side including outbound postage indicia in one corner thereof, a detachable strip along an edge of said card, said outbound postal indicia being located at least partially on said detachable strip, an original recipient's address on said front side, at least a portion of one of said front side and said back side containing information directed to the original recipient, said back side of said card containing postage indicia along the edge of said card opposite said detachable strip, a portion of said back side including the sender's address, and a removable label at least partially covering said sender's address and at least partially covering said postage indicia whereby said card may be remailed by removing said label and detaching said strip.

2. The card of claim 1 wherein said strip extends completely across said card and includes a perforated line to facilitate its detachability.

3. The card of claim 2 wherein said removable label includes a corner which functions as a handle means.

4. The card of claim 3 wherein a bar code is provided on at least one side of said card.

5. The card of claim 4 wherein bar codes are provided on both sides of said card.

6. The card of claim 5 wherein said removable label at least partially conceals the postage indicia on said back side.

7. The card of claim 6 wherein said outbound postage indicia is located at the diagonally opposite corner of said postal indicia on said back side.

8. The card of claim 7 wherein said peel off label covers said bar code on said back side.

9. The card of claim 8 wherein said information is located on said front side of said card.

* * * * *